US006576852B1

(12) United States Patent
Shu

(10) Patent No.: US 6,576,852 B1
(45) Date of Patent: Jun. 10, 2003

(54) NIGHT LAMP WITH A REVOLVING SWITCH

(76) Inventor: Kuo-Fen Shu, 2F-1, No. 152, Nan Yar Street, Hsinchu City (TW)

( * ) Notice: Subject to any disclaimer, the term of this patent is extended or adjusted under 35 U.S.C. 154(b) by 0 days.

(21) Appl. No.: 10/270,281

(22) Filed: Oct. 15, 2002

(51) Int. Cl.[7] ..... H01R 13/00
(52) U.S. Cl. ..... 200/51 R; 200/51.11; 439/13
(58) Field of Search ..... 200/51 R, 51.11, 200/51.17, 564, 567, 568, 572; 439/11, 13, 25, 18, 29, 336–338

(56) References Cited

U.S. PATENT DOCUMENTS 5,113,044 A * 5/1992 Tomberlin ..... 200/51.11
5,180,050 A * 1/1993 Rada et al. ..... 200/11 R
5,954,519 A * 9/1999 Hsiao ..... 439/21
6,093,028 A * 7/2000 Yang ..... 439/13
6,420,667 B1 * 7/2002 Miwa et al. ..... 200/5 R

* cited by examiner

*Primary Examiner*—Elvin Enad
*Assistant Examiner*—M. Fishman
(74) *Attorney, Agent, or Firm*—Rosenberg, Klein & Lee

(57) ABSTRACT

The present invention relates to a revolving switch of night lamp, which includes a joint and a connector connecting with a bulb. The connector and the bulb can be rotated at will when the joint is engaged with an indoor socket. A control mechanism is provided in the connector and a cap outside the connector connected with the control mechanism can be revolved in ease for turning on or off bulb.

1 Claim, 4 Drawing Sheets

NIGHT LAMP WITH A REVOLVING SWITCH

BACKGROUND OF THE INVENTION

A conventional night lamp usually includes a fixed body having plugs to connect with an indoor socket and a normal turning switch for controlling the lamp being on or off. An improved night lamp has a rotary connector to connect with a bulb, which is applied for patent by the same applicant of this case with U.S. Ser. No. 10/195,539. It has the rotary bulb for increasing practical utility.

The primary object of the invention is to provide a further improvement according to the said application, which provides a novel control mechanism to turn on or off the bulb. Now the features and advantages of the present invention will be described in detail with reference to the accompanying drawings.

BRIEF DESCRIPTION OF ACCOMPANYING DRAWINGS

FIG. 3 is a partly cross-sectional plan view of FIG. 1 after completely assembling when the bulb is turned on.

DETAILED DESCRIPTION OF PREFERRED EMBODIMENTS

Figure 1:
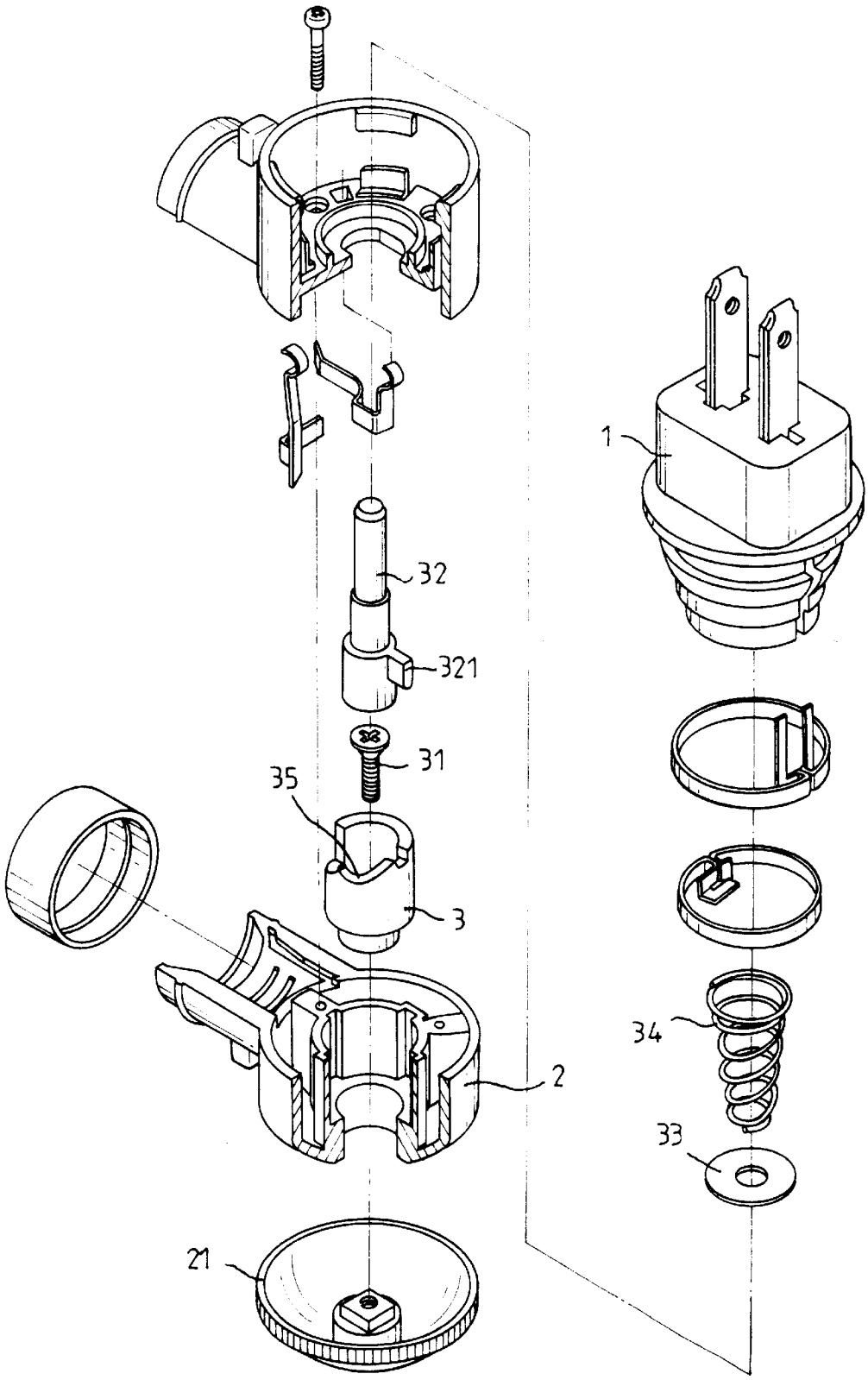
FIG. 1 is an exploded perspective view showing a night lamp with a revolving switch according to the present invention.
Figure 2:
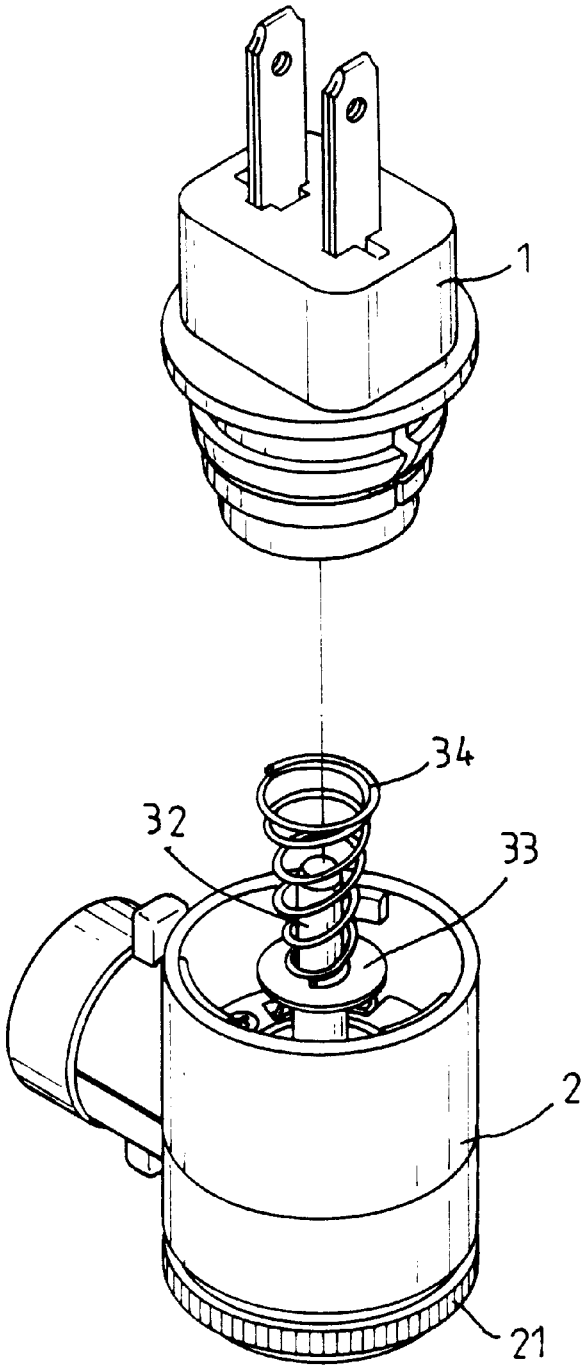
FIG. 2 is a perspective view of FIG. 1 after partly assembling.

Please refer to FIGS. 1 and 2, the present invention includes a joint (1) having two plugs to connect with an indoor socket for electrical conduction. Each plug has its inner end to contact with an elastic plate of a related metal ring and is electrical connected with a bulb (4) engaged with a connector (2). The aforesaid structure is similar to the case of U.S. Ser. No. 10/195,539 and is not described detailedly here.

The characteristic of this invention is about the control mechanism, being a revolving switch, for the bulb (4) on the connector (2). It includes a holder (3) for moving a shaft (32) to control a metal plate (33) being contacting or separating from a conductive ring that causes the electrical connecting on or off. The holder (3) connects with a cap (21) outside the connector (2) by a screw (31) and has a curved flange (35).

The shaft (32) placed in the holder (3) has a wing (321) laying on the curved flange (35). The inner end of the shaft (32) passes through the metal plate (33) and a coil spring (34) and inserts into a central groove in the joint (1).

Figure 3:
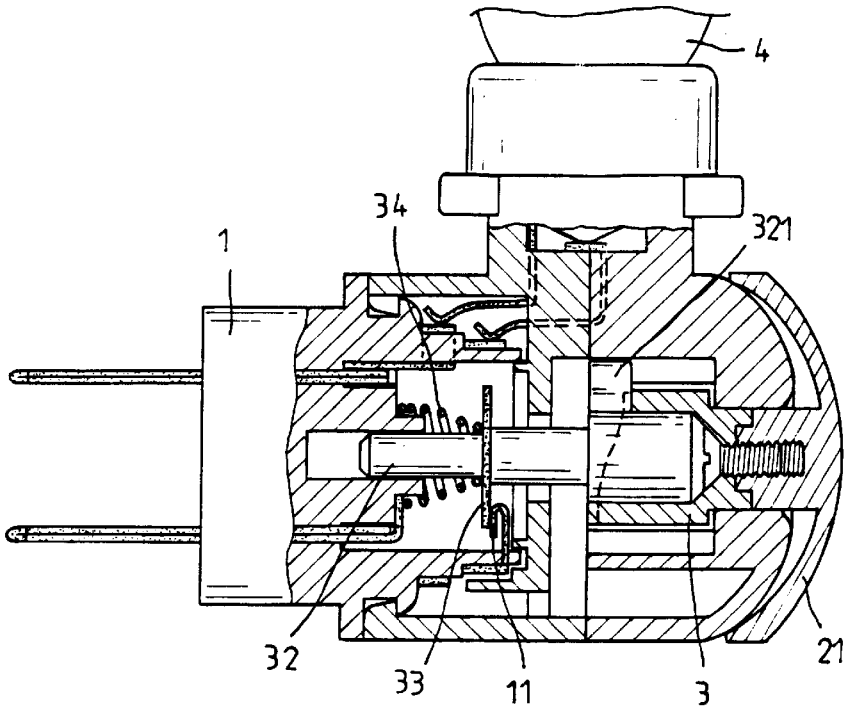
Figure 4:
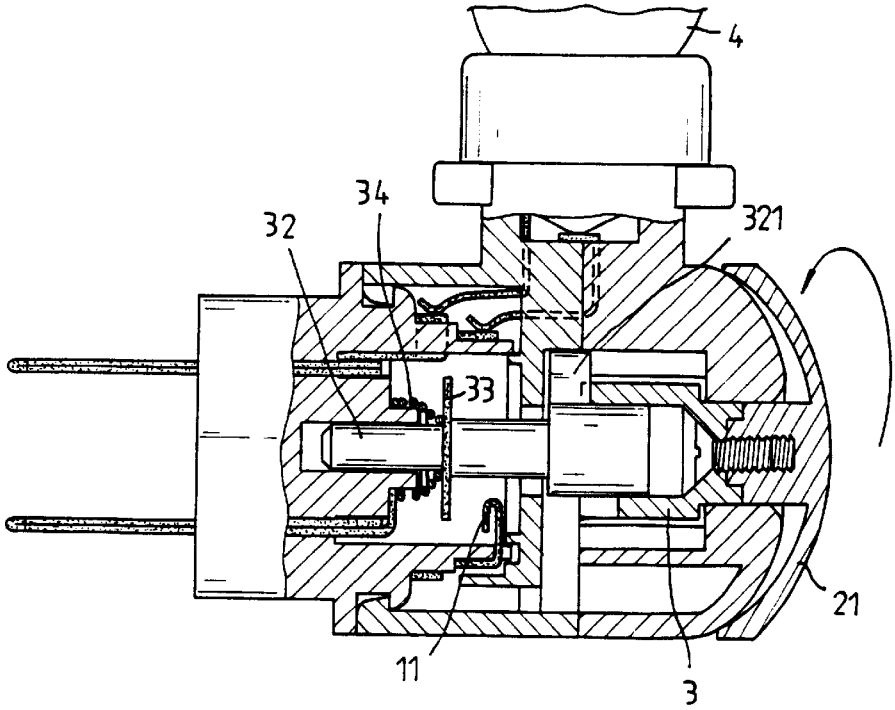
FIG. 4 is a partly cross-sectional plan view of FIG. 1 after completely assembling when the bulb is turned off.

As the wing (321) of the shaft (32) lays on a lower position of the curved flange (35) of the holder (3), shown in FIG. 3, the metal plate (33) under the elastic force of the coil spring (34) can contact with a folded edge (11) of the metal ring that forms an electrical connection of the circuit for lighting the bulb (4). As rotating the cap (21), the curved flange (35) can push the wing (321) as well as the shaft (32) to move inside that also pushes the metal plate (33) moved and separated from the edge (11). So the electrical circuit is cut and the bulb (4) is off, as shown in FIG. 4.

Figure 5:
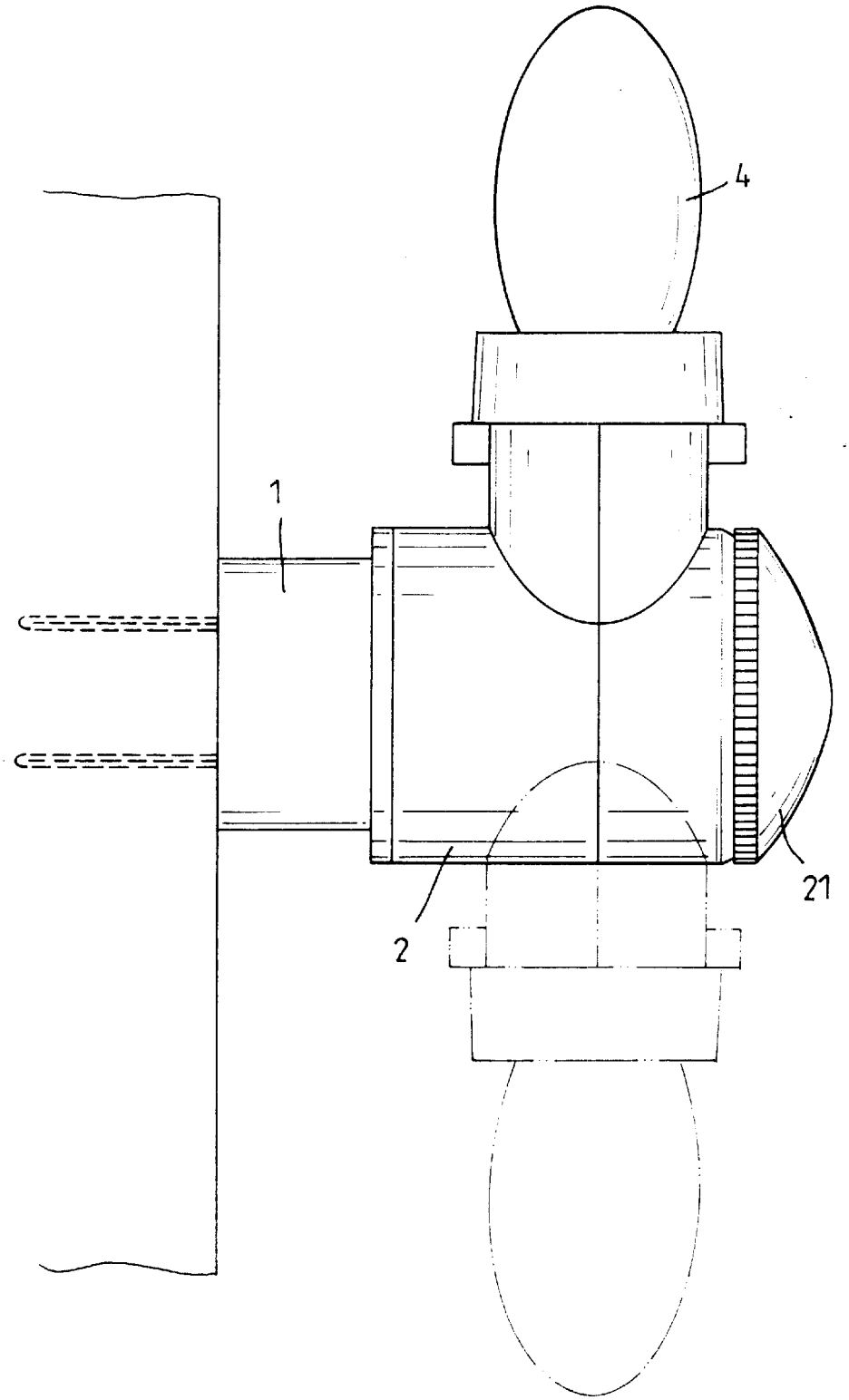
FIG. 5 is a plan view of a night lamp in use.

Accordingly, the present invention provides the revolving switch to control the bulb to be turned on or off easily. It will be stable and effective in use. While the plug is connected with the socket, the bulb and the connector can be rotated to a desired angle or position at will, such as in FIG. 5. Hence, it obviously achieves utility and improvement and should be allowed for patent.

What is claimed is:

1. A revolving switch of a night lamp including a joint and a connector, wherein the joint having two plugs to connect with an indoor socket for electrical conduction, and each plug having its inner end to contact with an elastic plate of a related metal ring and being electrical connected with a bulb engaged with a connector;

the characteristic is to provide a control mechanism, being a revolving switch, which includes a holder for moving a shaft to control a metal plate being contacting or separating from a conductive ring that causes the electrical connecting on or off, the holder connecting with a cap outside the connector by a screw and having a curved flange, and the shaft placed in the holder having a wing laying on the curved flange, wherein the inner end of the shaft passes through the metal plate and a coil spring and inserts into a central groove in the joint;

as the wing of the shaft laying on a lower position of the curved flange of the holder, the metal plate under the elastic force of the coil spring contacting with a folded edge of the metal ring that forms an electrical connection of the circuit for lighting the bulb, and as rotating the cap, the curved flange pushing the wing as well as the shaft to move inside that also pushes the metal plate moved and separated from the edge, meanwhile the electrical circuit being cut and the bulb being off.

* * * * *